US005081859A

United States Patent [19]

De Smet

[11] Patent Number: 5,081,859

[45] Date of Patent: Jan. 21, 1992

[54] DEVICE FOR PRESSING SHEET MATERIAL ON AN ELASTIC FORMING DIE

[75] Inventor: Gabriel De Smet Nogent sur Oise, France

[73] Assignee: Isoform, Puteaux, France

[21] Appl. No.: 457,517

[22] Filed: Dec. 27, 1989

[30] Foreign Application Priority Data

Dec. 30, 1988 [FR] France ..... 88 17526

[51] Int. Cl.[5] ..... B21D 22/10; B21D 26/00

[52] U.S. Cl. ..... 72/57; 29/421.1; 72/465

[58] Field of Search ..... 72/56, 57, 60, 63, 465; 29/421.1

[56] References Cited

U.S. PATENT DOCUMENTS

| | | | |
|---|---|---|---|
| 2,719,500 | 10/1955 | Kraybill . | |
| 2,783,728 | 3/1957 | Hoffmann | 72/57 |
| 3,552,165 | 1/1971 | Taylor | 72/57 |
| 4,770,015 | 9/1988 | De Smet | 72/63 |
| 4,833,903 | 5/1989 | De Smet | 72/57 |

FOREIGN PATENT DOCUMENTS

| | | | |
|---|---|---|---|
| 0221134 | 11/1985 | Japan | 72/57 |
| 615998 | 2/1976 | U.S.S.R. . | |
| 0799869 | 1/1981 | U.S.S.R. | 72/465 |
| 0994770 | 6/1965 | United Kingdom | 72/63 |
| 2151527 | 7/1985 | United Kingdom . | |

OTHER PUBLICATIONS

"Adiprene ® Urethane Rubber", DuPont, Nov. 1963, Tool and Manufacturing Engineer, vol. 51.

*Primary Examiner*—David Jones

*Attorney, Agent, or Firm*—Fay, Sharpe, Beall, Fagan, Minnich & McKee

[57] ABSTRACT

Pressing sheet material with a device comprising a cushion (6) composed of an elastic material, comprising disposing a sheet blank (3) to be formed on a support constituting a lower peripheral blank holder (2*a*), applying an upper blank holder (1*a*) on the peripheral portion of the sheet blank (3) for preforming the blank, then applying a punch (4) on the central portion of the sheet blank (3) for effecting the final forming, wherein, in the course of the final forming, the excess volume of the elastic cushion (6), produced by the application of the punch (4), relative to the volume determined by the surface area of the finished part to be obtained, is absorbed.

18 Claims, 9 Drawing Sheets

DEVICE FOR PRESSING SHEET MATERIAL ON AN ELASTIC FORMING DIE

The present invention relates to a method and device for pressing sheet material on an elastic forming die.

A method for pressing on an elastic cushion has been proposed in U.S. Pat. No. 4,833,903 and U.S. Pat. No. 4,770,015. This method comprises disposing the sheet blank to be formed on an elastic cushion, applying an outer slide carrying a blank holder on the peripheral portion of the sheet blank so as to cause the flowing of the mass of the elastic cushion and deform the central portion of the sheet blank by imparting thereto at the end of the performing step a surface area substantially equal to the surface area of the finished part to be obtained, then applying a central slide acting through a punch on the central portion of the sheet blank for imparting to the part its final shape.

This method permits the pressing of a sheet material, in particular a material having a low elongation, which may be in particular a sheet of metal, for example steel, although this method is not limited to the pressing of a metal sheet but is applicable to plastics materials and any other composite material.

The cushion composed of elastic material is described as being in particular capable of being a composite support constituted by a substantially parallel-sided mass based on a silicone elastomer of low Shore hardness which may be covered on its upper surface and on the whole or a part of its lateral surfaces with a relatively thin envelope composed of a stronger and harder material.

In the course of the preforming step, the blank holder applied on the peripheral portion of the sheet blank causes the flowing of the mass of the elastic cushion for deforming the central portion of the blank and imparting thereto, at the end of the preforming step, a surface area substantially equal to the surface area of the finished part to be obtained.

However, the descent of the punch for finally shaping the sheet blank creates an increase in the pressure in the cushion and a difference in the volume of the cushion between the preforming step and the final shaping step which must be compensated for by a decompression of the elastic cushion in order to avoid a deformation of the pressed part by reaction of the expansion of the elastic material of the cushion.

The invention therefore provides a method for pressing sheet material of the type comprising a cushion composed of an elastic material, said method comprising disposing a sheet blank to be formed on a support constituting a lower peripheral blank holder, applying an upper blank holder on the peripheral portion of the sheet blank for preforming the blank, then applying a punch on the central portion of the sheet blank for effecting the final shaping of the blank, wherein, in the course of the final shaping, the excess volume of the elastic cushion, produced by the application of the punch, relative to the volume determined by the surface area of the finished part to be obtained is absorbed.

The invention also provides a device for pressing sheet material comprising a cushion composed of an elastic material disposed in a retaining box, means for preforming a sheet blank constituted by an outer slide carrying an upper blank holder, and means for finally forming the sheet blank constituted by a central slide acting on a punch, said device further comprising means for absorbing the excess volume of the elastic cushion relative to the volume determined by the surface area of the final part to be obtained.

According to other features of the invention, the means for absorbing the excess volume of the elastic cushion are constituted by:

the bottom of the cushion-retaining box cooperating with means for controlling the displacement of said bottom;

at least one lateral wall of the cushion-retaining box cooperating with means for controlling the displacement of said lateral wall;

the upper blank holder cooperating with means modifying the penetration of the upper blank holder into the elastic cushion.

A better understanding of the invention will be had from the following description which is given solely by way of example with reference to the accompanying drawings, in which.

Figure 1:
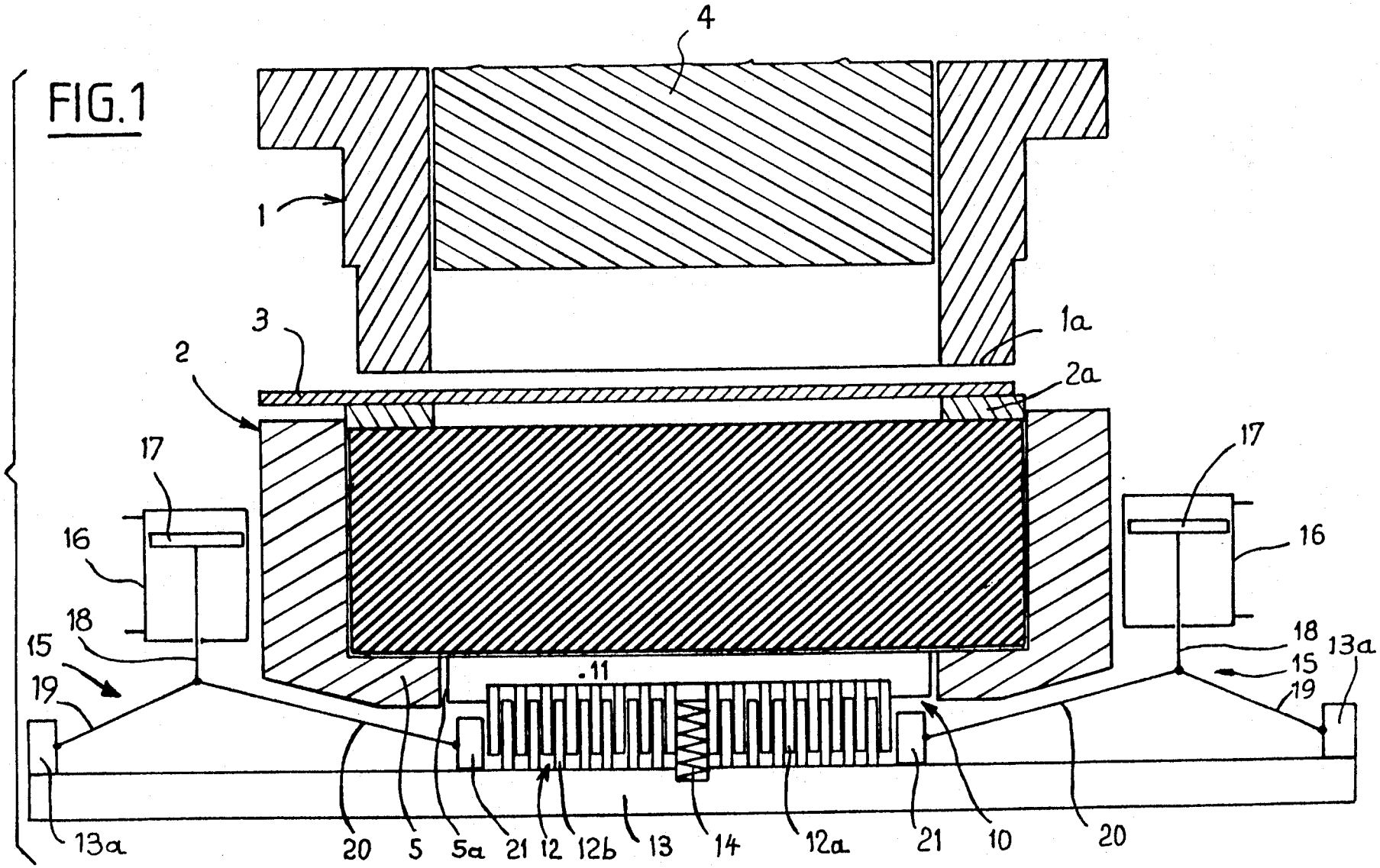
FIGS. 1 to 3 are diagrammatic sectional views of the pressing device according to the invention in the course of successive steps for forming a part.
Figure 2:
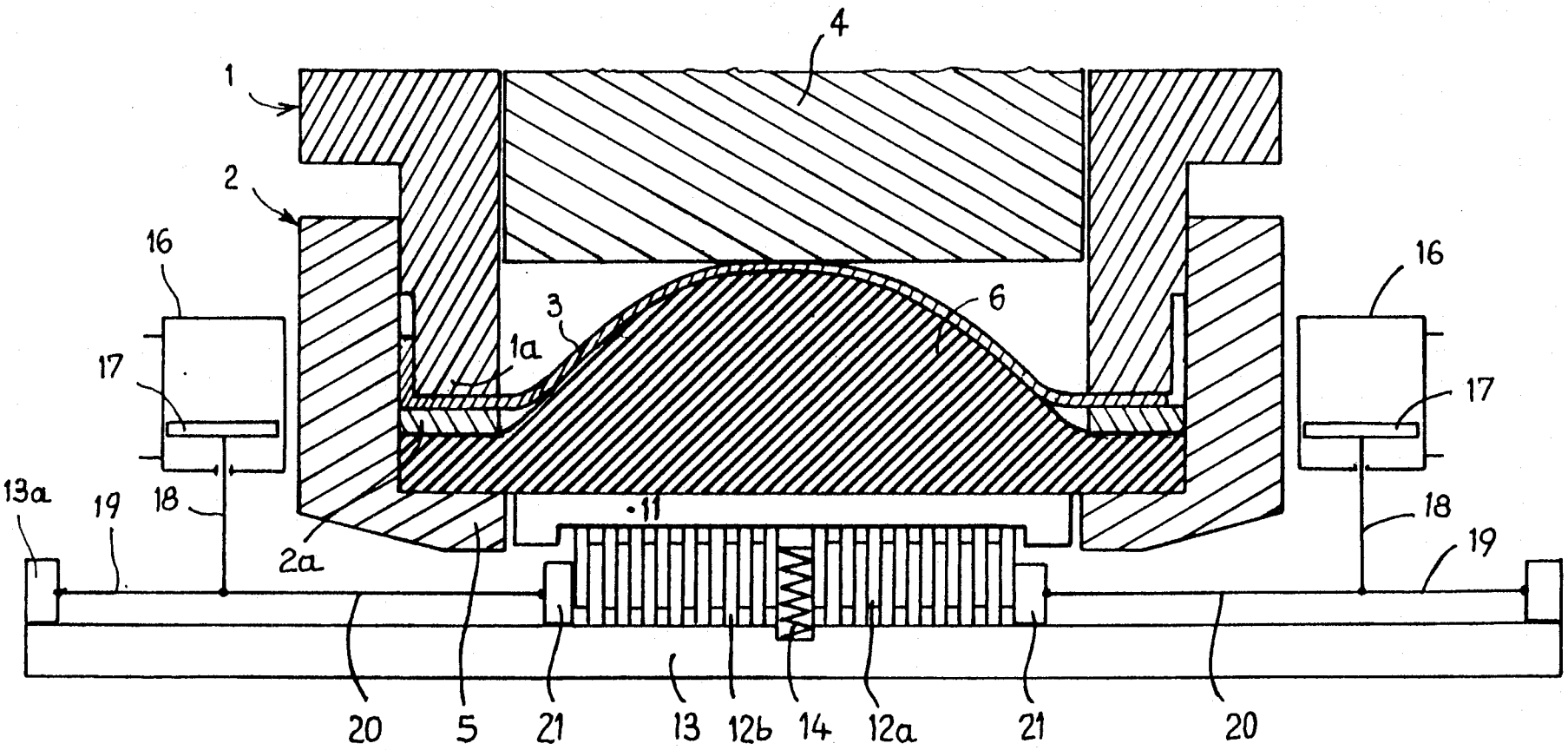
Figure 3:
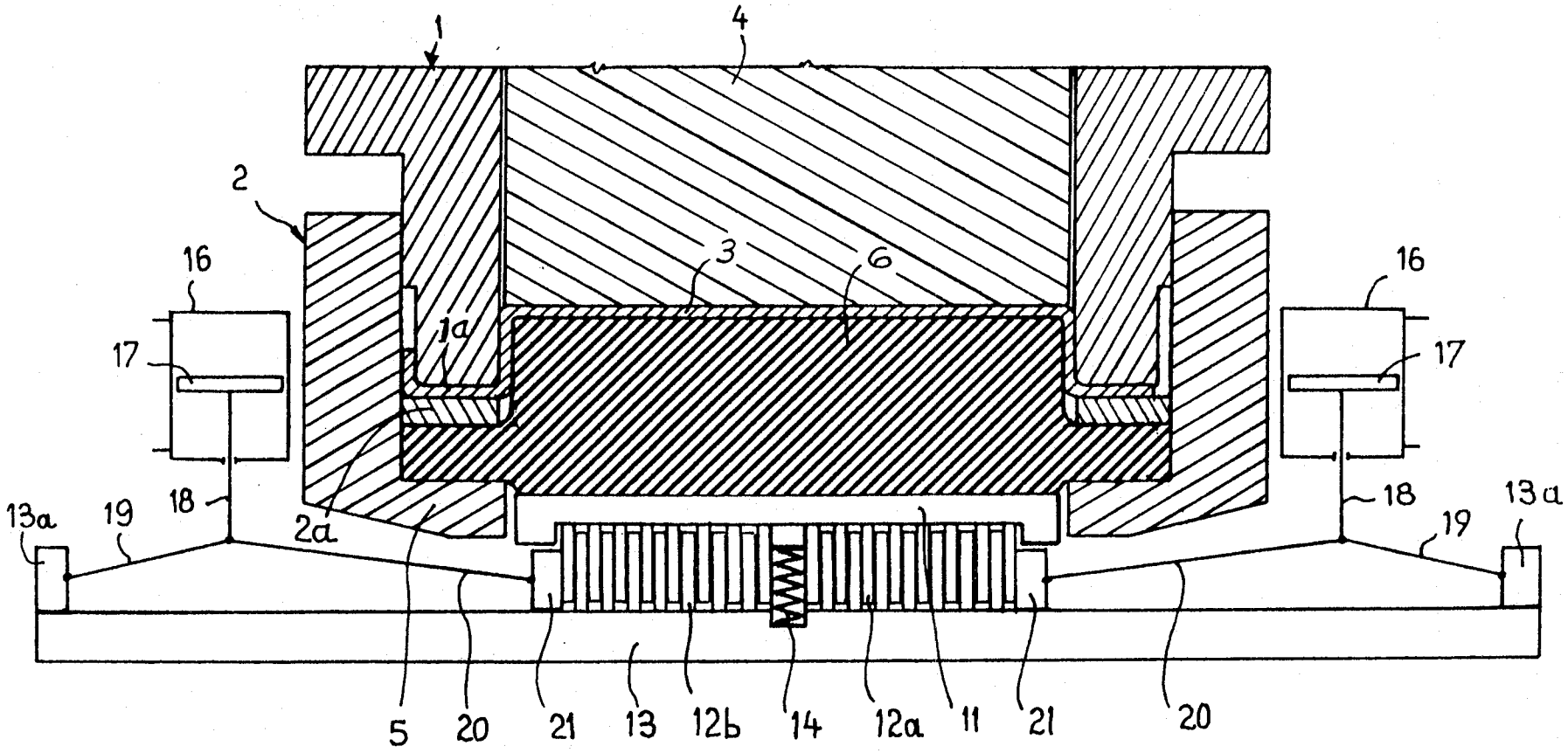

The pressing device shown in FIGS. 1 to 3 comprises a box 2 whose central part constitutes a cavity for a cushion 6 composed of an elastic material.

Disposed on the upper surface of the elastic cushion 6 is a frame 2*a* having a closed contour and constituting a lower peripheral blank holder and substantially marrying up with the contour of the inner cavity of the box 2 so as to be capable of entering said cavity when forming the part.

Above the box 2, the pressing device comprises a body 1 carried by an outer slide (not shown) and having a lower part constituting an upper peripheral blank holder 1*a*.

The upper peripheral blank holder 1*a* has outer dimensions slightly less than the contour of the inner cavity of the box 2 so as to cooperate with the frame 2*a* and enter said cavity.

The body 1 includes a central well into which extends a punch 4 whose lower surface constitutes a cavity corresponding to the profile of the finished part to be obtained.

The device further comprises means 10 for absorbing the excess volume of the elastic cushion 6, produced by the application of the punch 4, relative to the volume determined by the surface area of the finished part to be obtained.

These means 10 comprise a vertically movable piston 11 constituting the bottom 5 of the box 2, the latter having a central opening 5*a* for this purpose. The piston 11 has its upper surface applied against the elastic cushion 6 and cooperates with means for controlling the displacement of the piston formed, in the presently-described embodiment, by a multiplate brake 12.

This multiplate brake comprises, on one hand, downwardly extending upper friction plates 12*a* connected to the piston 11 and, on the other hand, upwardly extending lower friction plates 12*b* fixed to a sole plate 13 disposed below the bottom 5 of the box 2 at a given distance from this bottom. The upper and lower friction plates 12*a* and 12*b* are interposed relative to one another.

The assembly comprising the piston 11 and the friction plates 12*a* is biased by a spring 14 bearing against the sole plate 13.

The multiplate brake 12 is controlled on each side by a clamping mechanism 15 consisting of a control jack 16 whose piston 17 actuates a rod 18 articulated to two levers 19 and 20 forming a toggle for clamping the friction plates 12*a* and 12*b*. To this end, the free end of the lever 19 bears against a lateral flange 13*a* provided on the sole plate 13 and the free end of the lever 20 is connected to a small piston 21 which acts on the friction plates 12*a* and 12*b*.

The device operates in the following manner:

In the preforming step shown in FIG. 2, the body 1 is lowered by the outer slide (not shown) of the press in such manner that the upper blank holder 1*a* comes into contact with the sheet blank 3 whose peripheral region is progressively gripped between the lower blank holder 2*a* and the upper blank holder 1*a* so as to avoid the festooning of the blank. In the course of its descent, the upper blank holder 1*a* produces in localized regions a flanging of the edge portion of the sheet blank and by reaction compresses the elastic cushion 6. The latter, under the effect of this peripheral compression action, acts by a flowing thereof on the central region of the sheet blank and causes the deformation of the latter.

The swelling of the central portion of the sheet blank is limited by the bottom of the piston 4 for the purpose of avoiding uncontrolled erratic deformations of the blank.

At the start of the descent of the upper blank holder 1, a suitable mechanism (not shown) controls the jack 16 in such manner that, under the effect of the pistons 17 of the jacks, the rods 18 act on the levers 19 and 20 of each mechanism 15 and cause the displacement of the small pistons 21 toward each other so that the pistons clamp the friction plates 12*a* and 12*b* against one another.

In this way, during this preforming operation, the friction plates 12*a* and 12*b* are applied against one another and prevent the movable piston 11 from descending under the effect of the pressure in the elastic cushion 6 and, consequently, prevent the elastic cushion from flowing downwardly.

During the step for finally shaping the sheet blank 3 shown in FIG. 3, the punch 4 descends to its lower position and effects the final forming of the central portion of the blank 3 which had been preformed in the course of the preceding operation.

The stresses due to the bearing of the punch 4 against the top of the sheet blank 3 cause the displacement of the blank throughout the available volume and in this way permit the final forming of the part with a minimum of variations in thickness.

A suitable mechanism (not shown), controlled for example by a pressure sensor disposed in the elastic cushion 6, actuates the jacks 16 which act on the levers 19 and 20 in such manner as to vary the clamping of the friction plates 12*a* and 12*b*, which permits controlling the displacement of the piston 11 and absorbing the excess volume of the elastic cushion 6, produced by the application of the punch 4, relative to the volume determined by the surface area of the finished part to be obtained.

At the end of the cycle, after the rising of the punch 4 and upper blank holder 1*a*, the jacks 16 completely unclamp the friction plates 12*a* and 12*b* and, as there is no longer any pressure existing in the elastic cushion 6, the return spring 14, which has merely to overcome the weight of the movable piston 11, the elastic cushion 6 and various frictions, raises the movable piston. Consequently, the means 10 permit, in the course of the operation for finally shaping the part, absorbing the excess volume of the elastic cushion 6 by controlling the displacement of the piston 11 by means of the multiplate brake 12.

Figure 4:
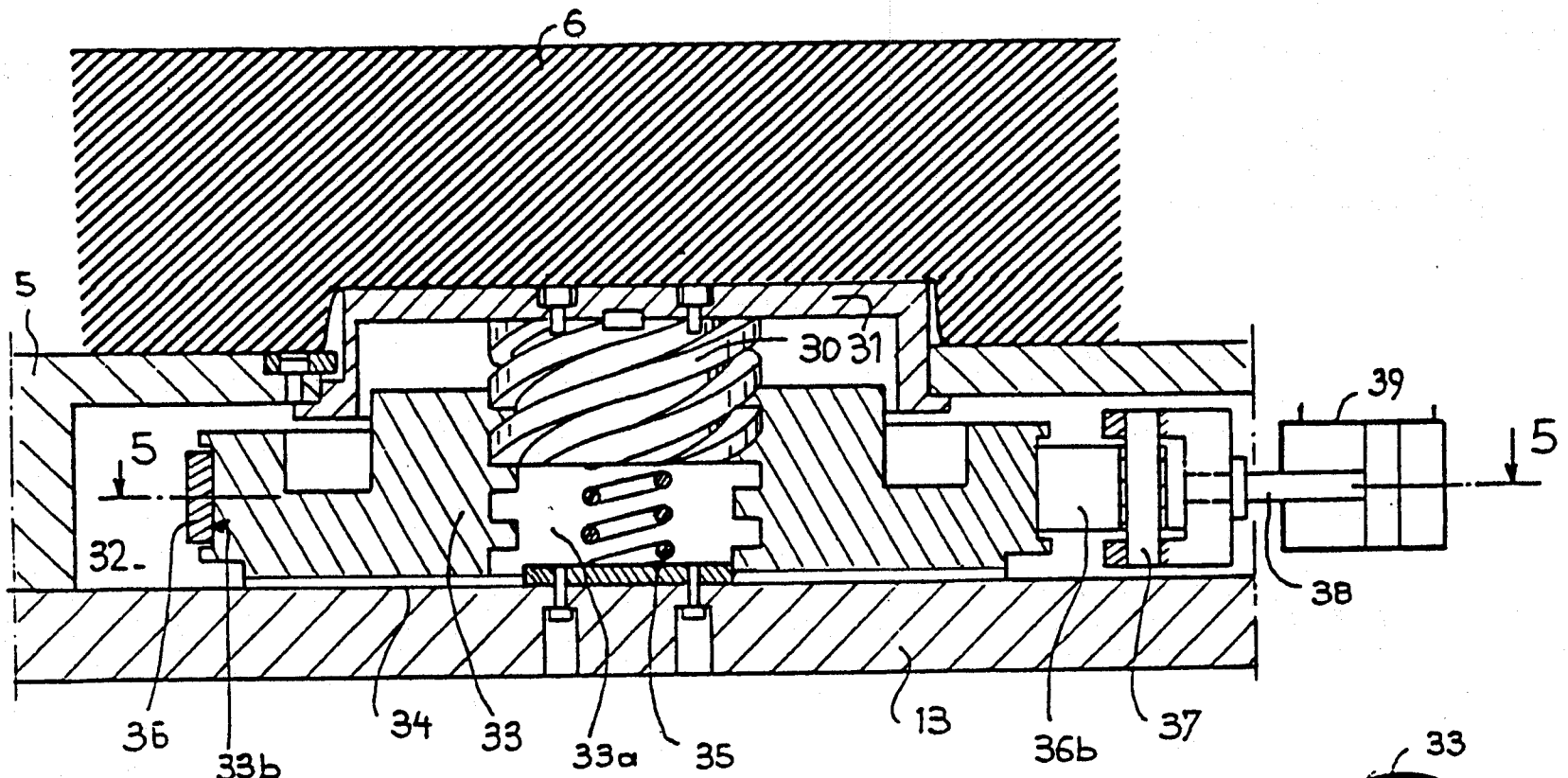
FIG. 4 is a diagrammatic sectional view of a first variant of the pressing device according to the invention.

According to another variant illustrated in FIG. 4, the means 10 for absorbing the excess volume of the elastic cushion 6 comprises a piston 31 in contact with the elastic cushion 6 and connected to rotate with a reversible screw 30 which cooperates with a belt brake (33–36) constituting the means for controlling the displacement of the piston.

The bottom 5 of the box containing the elastic cushion 6 bears against the sole plate 13 and defines with the latter a central cavity 32. A friction thrust member 34 is interposed between the rotatable nut 33 of the belt brake 33–36 and the sole plate 13.

The rotatable nut 33 defines a central opening 33*a* provided with an internal screw thread cooperating with the screw 3. A spring 35 is placed in the opening 33*a* between the bottom of the screw 30 and the sole plate 13.

The nut 33 also includes on its periphery a groove 33*b* in which a brake belt 36 is located.

Figure 5:
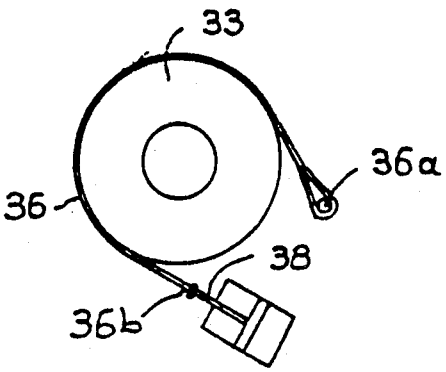
FIG. 5 is a sectional view to an enlarged scale taken on line 5—5 of FIG. 4.

As can be seen in FIG. 5, the brake belt 36 surrounds the rotatable nut 33 and has one of its ends 36*a* immobilized and the other end 36*b* connected by a fastening mechanism 36 with the end of a rod 38 of a jack 39 controlling the tension of the brake belt.

In the course of the descent of the upper blank holder for preforming the sheet blank, the jack 39 exerts a tension on the brake belt 36 which has for effect to immobilize the nut 33, the screw 30 and the piston 31 and thereby prevent the elastic cushion 6 from flowing downwardly.

During the operation for finally forming the blank by means of the punch, the jack 38 controlled by a suitable mechanism (not shown) tightens the brake belt 36 to a varying extent, which permits controlling the displacement of the piston 31 and absorbing the excess volume of the elastic cushion 6 relative to the volume determined by the surface area of the finished part to be obtained.

At the end of the cycle, after the rising of the punch and upper blank holder, the return spring 35 causes the piston 31 to rise under the action of the screw 30.

Figure 6:
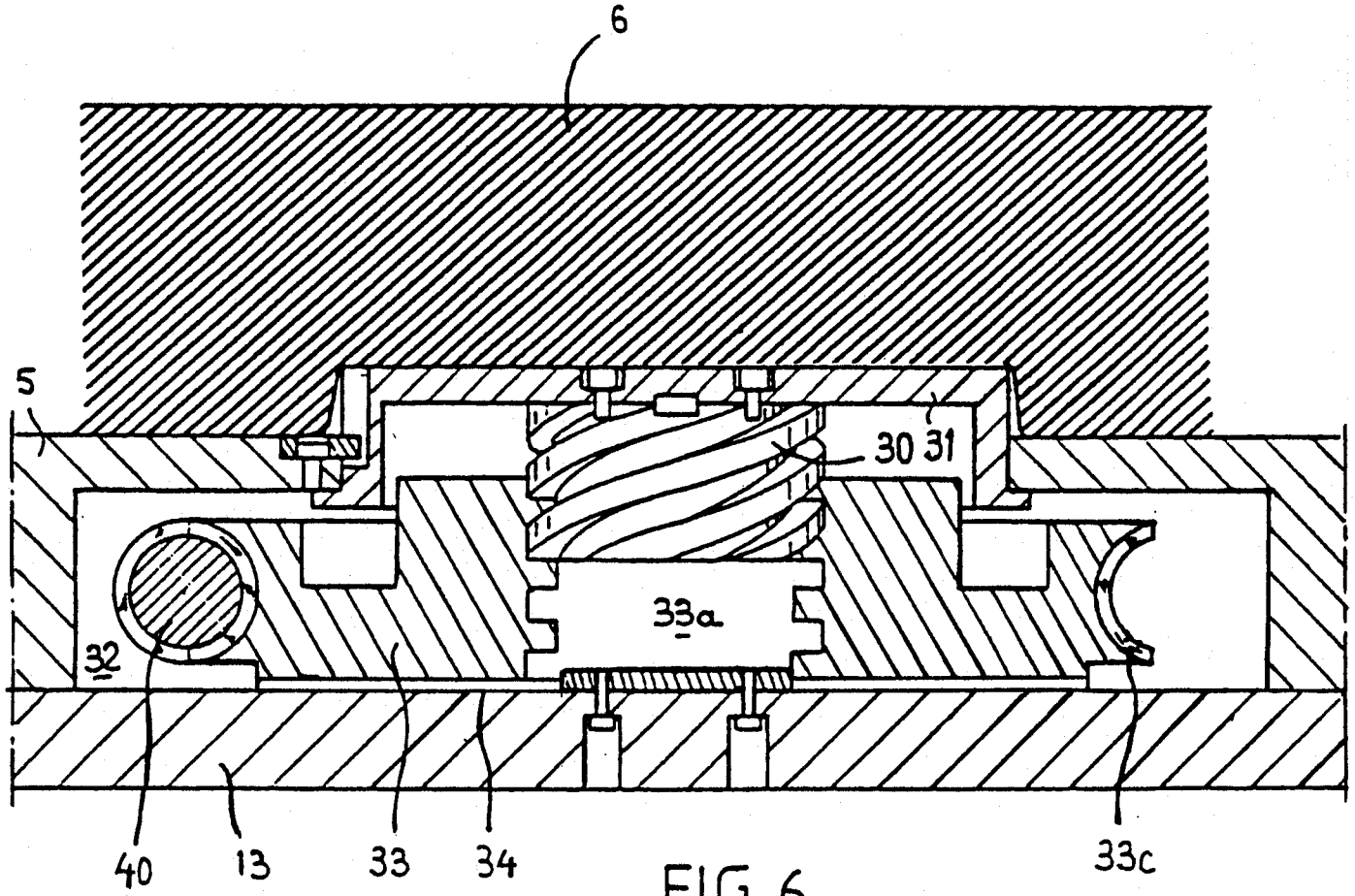
FIG. 6 is a diagrammatic sectional view of a second variant of the pressing device according to the invention.

In the variant shown in FIG. 6, the rotatable nut 33 comprises on its periphery gear means consisting of a toothed groove 33*c* which cooperates with a worm 40 controlled for example by a motor (not shown) in a step-by-step manner, or by any other suitable means.

Figure 7:
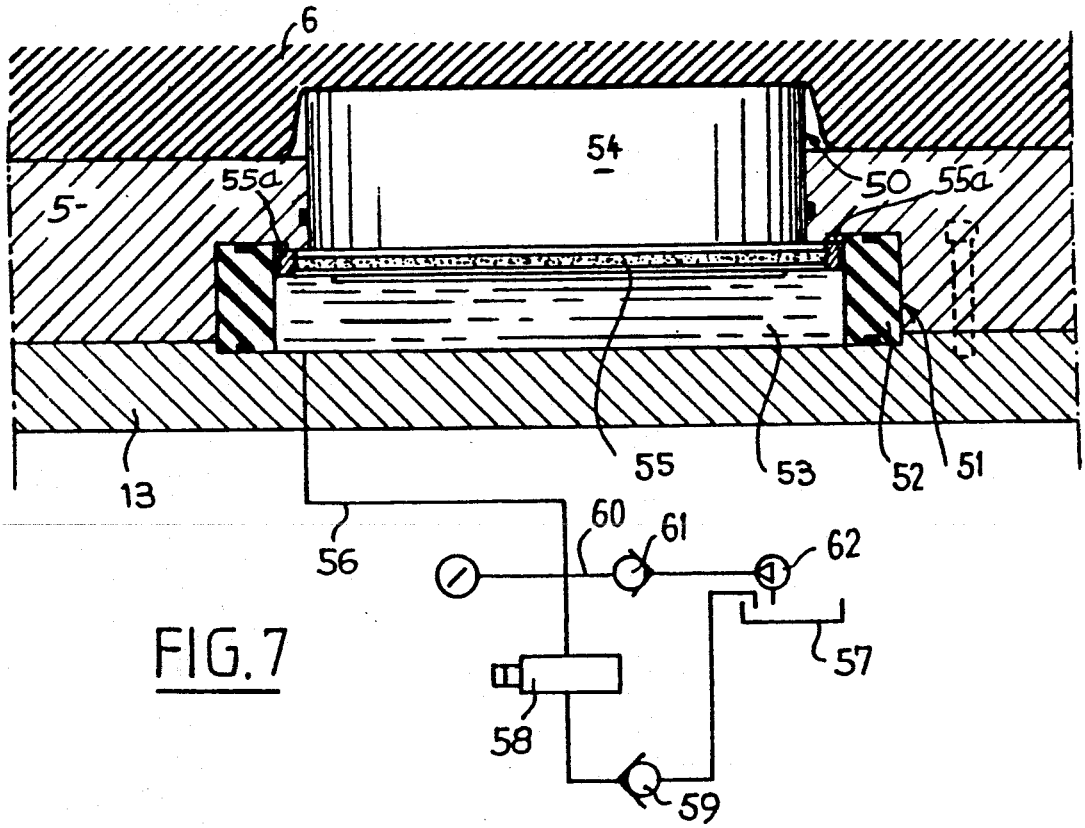
FIG. 7 is a diagrammatic sectional view of a third variant of the pressing device according to the invention.
Figure 8:
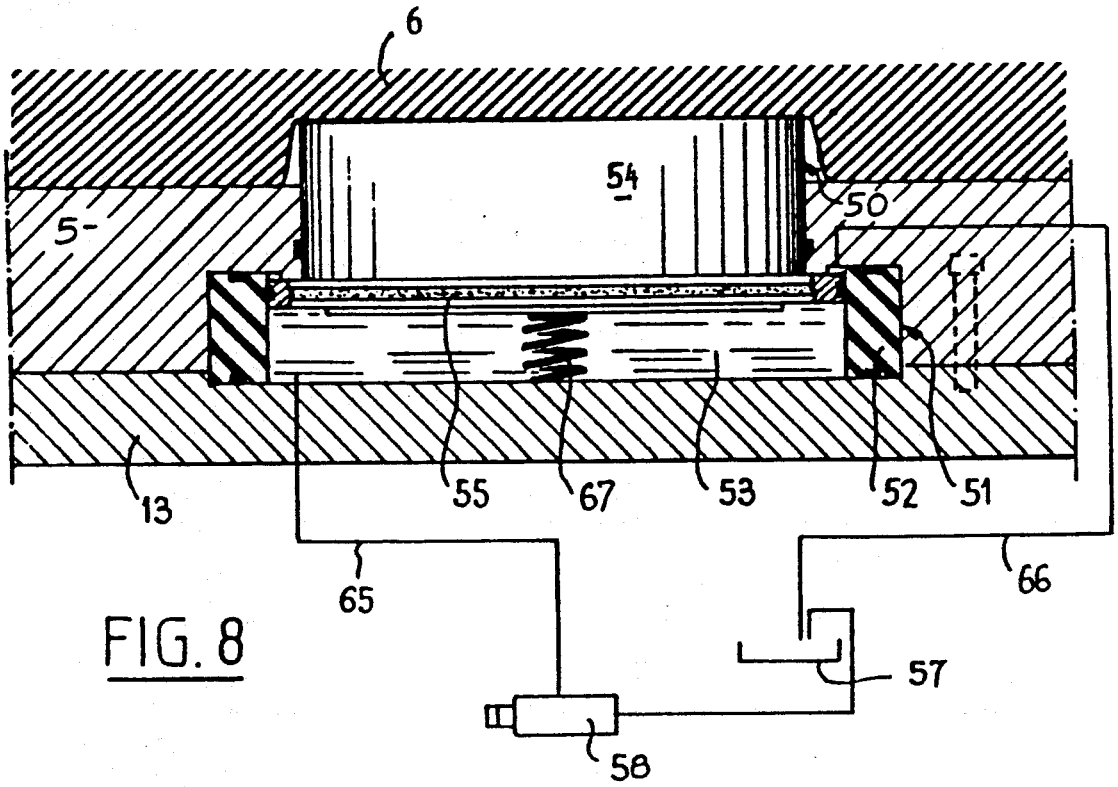
FIG. 8 is a diagrammatic sectional view of a fourth variant of the pressing device according to the invention.

In the other two variants shown in FIGS. 7 and 8, the means 10 for absorbing the excess volume of the elastic cushion 6 when effecting the final shaping of the part are constituted by a hydraulic jack 50.

To this end, the bottom 5 of the box bears against the sole plate 13 and defines with the latter a cylindrical cavity 51 in which is disposed a cylinder 52 defining an inner chamber 53 filled with a fluid.

The bottom 5 of the box is formed by a piston 54 whose upper surface is in contact with the elastic cushion 6 and which includes in its lower part a cylindrical base 55 which is slidable inside the cylinder 52. The cylindrical base 55 includes sealing means 55*a* on its periphery.

The hydraulic circuit controlling the jack 50 comprises a conduit 56 having one end opening into the inner chamber 53 below the base 55 and the opposite end connected to a fluid reservoir 57. Inserted in this conduit 56 are, on one hand, a pressure reducer 58 controlled in a proportional manner and programmed electrically, mechanically or pneumatically in accordance with the pressure desired in the elastic cushion 6 and, on the other hand, a check-valve 59 allowing the flow of the fluid from the chamber 33 to the reservoir 57.

The conduit 56 also includes, on the upstream side of the pressure reducer 58, a branch connection constituted by a conduit 60 including a check-valve 61 allowing the flow of the fluid from the reservoir 57 to the chamber 53 and a pump 62 which draws off fluid from the reservoir 57.

In the variant shown in FIG. 8, the hydraulic circuit controlling the jack 50 comprises a conduit 65 having one end opening into the inner chamber 53 below the base 55 of the piston 54 and the opposite end connected to the reservoir 57. Only the pressure reducer 58 is inserted in this conduit.

Further, the hydraulic circuit also includes another conduit 66 having one end opening into the inner chamber 53 above the base 55 and the opposite end connected to the reservoir 57. In this case, a return spring 67 is placed in the inner chamber 53 between the base 55 and the sole plate 13 for returning the piston 54 to its initial position subsequent to the final shaping step.

In these two embodiments, the hydraulic circuit permits, by means of the piston 54, absorbing the excess volume of the elastic cushion in the course of the step for finally shaping the part, by controlling the displacements of the piston 54 relative to the final part to be obtained.

Figure 9:
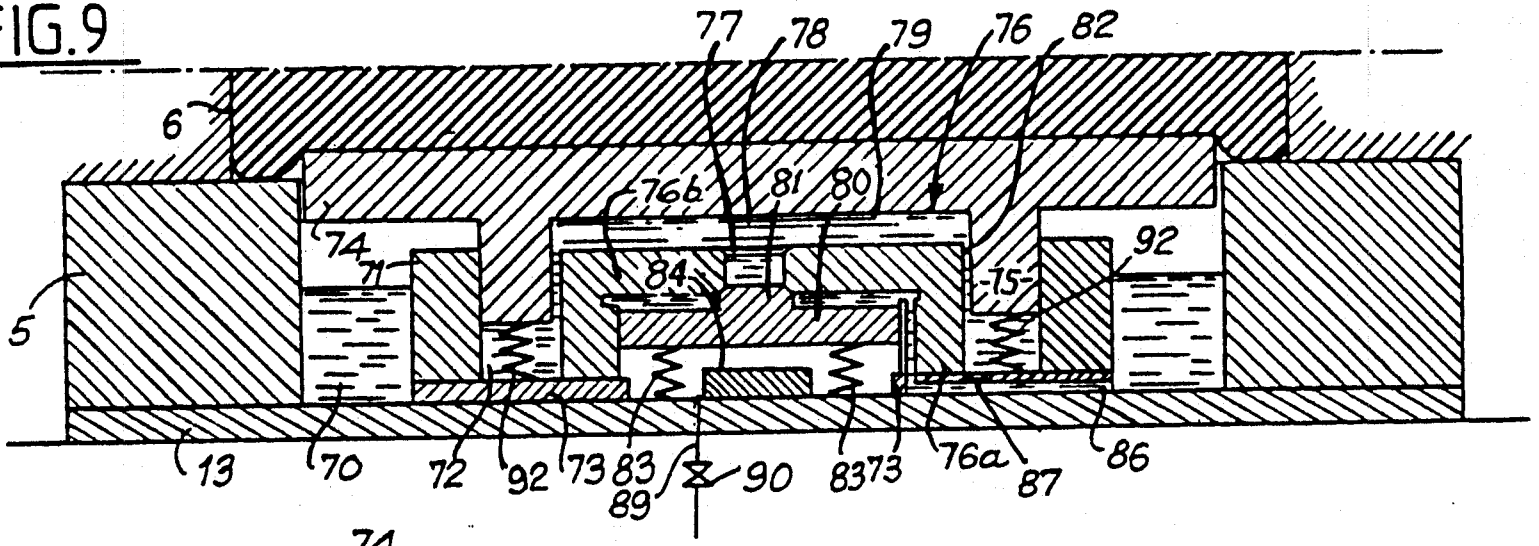
FIGS. 9, 10 and 11 are diagrammatic sectional views of a fifth variant of the pressing device according to the invention, in the course of successive steps for forming a part.
Figure 10:
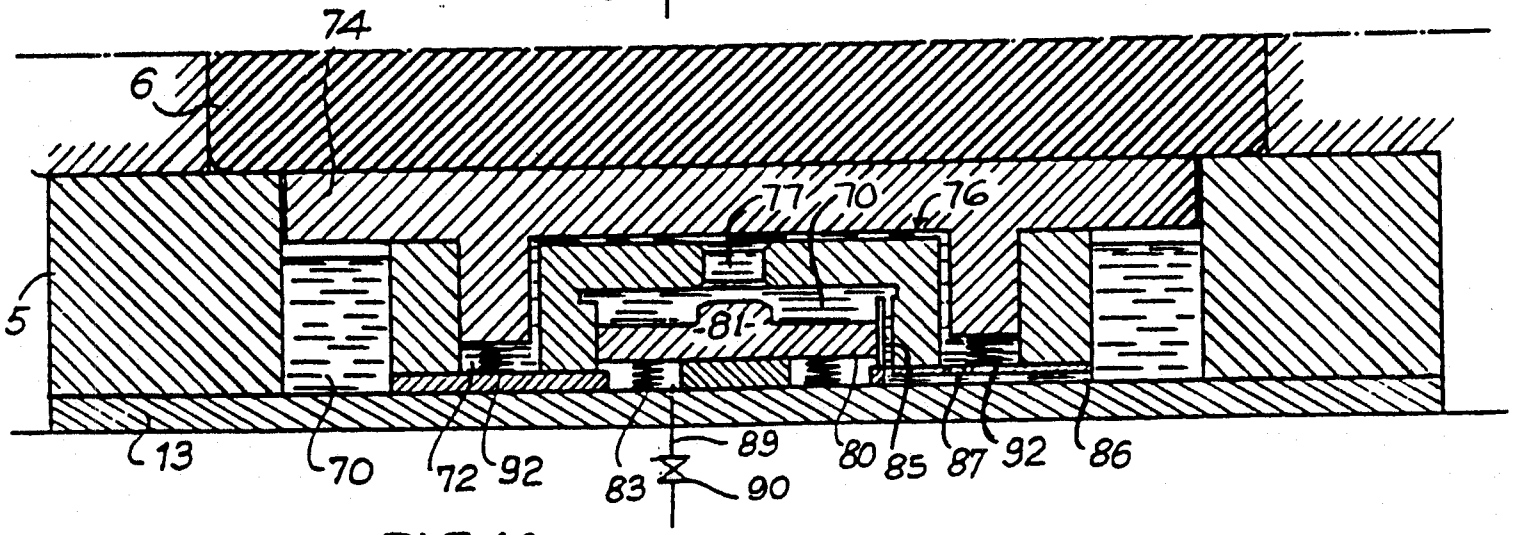
Figure 11:
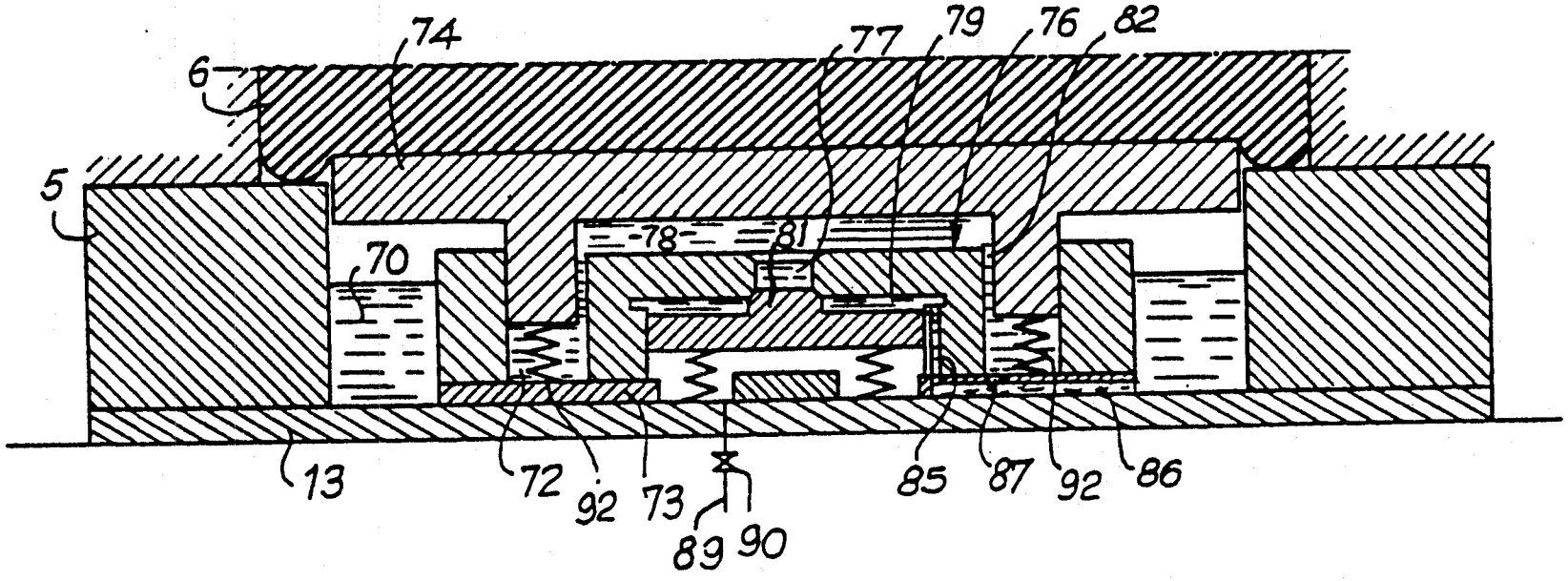

In another embodiment shown in FIGS. 9 to 11, the means 10 for absorbing the excess volume of the elastic cushion 6 when effecting the final shaping of the part are constituted by a hydraulic valve controlled by a pneumatic valve.

For this purpose, the bottom 5 of the box bears against the sole plate 13 and defines with the latter a cylindrical cavity 70 in which is disposed a cylinder 71 defining an inner chamber 72. The cylinder 71 has a diameter which is smaller than the inside diameter of the retaining box and bears against a bearing plate 73 placed on the sole plate 13.

The bottom 5 of the box consists of a piston 74 whose upper surface is in contact with the elastic cushion 6 and which includes in its lower part a cylindrical extension 75 which is slidable in the cylinder 71. The piston 74 is returned by springs 92 disposed between the bottom of the cylindrical extension 75 and the plate 73.

Disposed inside the cylindrical extension 75 of the piston 74 is a cup 77 which comprises a lower skirt 76*a* bearing against the plate 73 and an upper wall 76*b* provided with a central orifice 77. The cup 76 defines with the piston 74 an upper chamber 78 and includes an inner chamber 79 in which is slidable a small piston 80 comprising on its upper surface a valve closure member 81 cooperative with the lower part of the orifice 77 which forms a valve seat.

Further, the cup 76 has an outside diameter slightly smaller than the inside diameter of the cylindrical extension 75 of the piston 74 so as to form an annular space 82 putting the upper chamber 78 in communication with the chamber 72.

The small piston 80 is biased upwardly by springs 83 which bear against the sole plate 13 and its downward travel is limited by an abutment 84.

The skirt 76*a* of the cup 76 and the bearing plate 73 are provided with small passageways 85 and 86 which put the upper chamber 78 in communication with the cavity 70. Further, the bearing plate 73 is provided with small orifices 87 which include check-valves and put the chamber 72 in communication with the small passageways 86.

A conduit 89 provided with a valve 90 opens out between the small piston 80 and the sole plate 13.

The cavity 70 constitutes a reservoir for fluid which fills the chambers 72, 78 and 79 and the small passageways 85 and 86.

When the upper blank holder descends for preforming the part, the valve 90 is opened and the compressed air acts on the small piston 80 in such manner as to apply the valve member 81 against its seat. The orifice 77 is closed and this prevents the fluid from flowing from the chamber 78 to the chamber 79 and consequently the elastic cushion 6 from flowing downwardly.

During the final shaping operation of the punch (FIG. 10), the supply of compressed air is stopped. Under the effect of the pressure exerted on the elastic cushion 6 by the punch, the piston 74 descends and causes by means of the fluid contained in the chamber 78 the opening of the valve 81. The fluid flows from the chamber 78 to the chamber 79, then to the cavity 70 through the small passageways 85 and 86. This arrangement permits controlling the displacement of the piston 74 and absorbing the excess volume of the elastic cushion 6 relative to the volume determined by the surface area of the finished part to be obtained.

At the end of the cycle (FIG. 11), after the punch and upper blank holder have risen, the return springs 92 raise the piston 74 and the springs 83 raise the piston 80 and thereby close the orifice 77 by means of the valve member 81.

Under the effect of the suction created in the chamber 70 by the rising of the piston 74, the small valves disposed in the orifices 87 open and the fluid flows from the cavity 70 to the chamber 72 by way of the passageways 86 and the orifices 87, then from the chamber 72 to the chamber 78 by way of the annular space 82.

Figure 12:
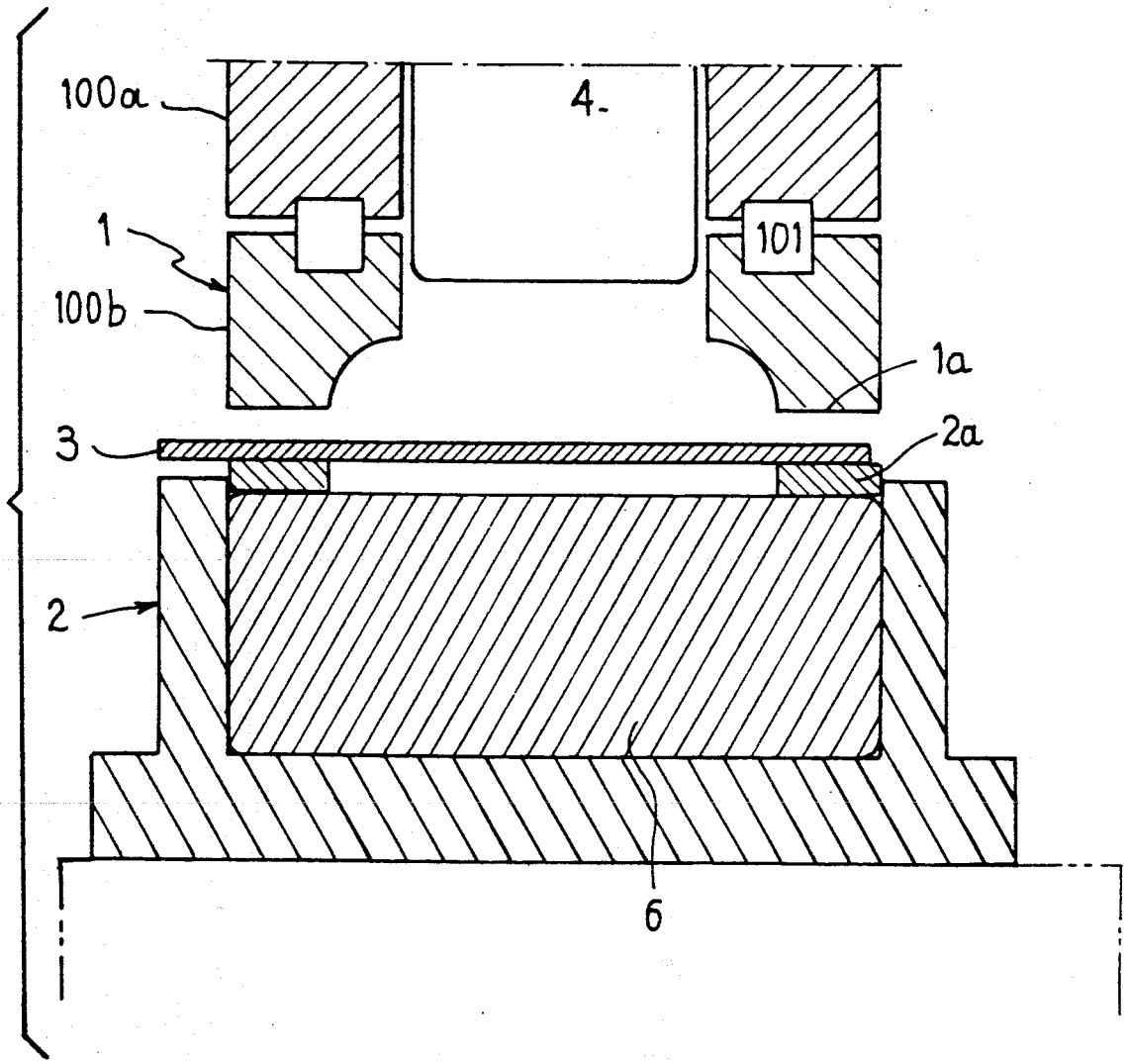
FIG. 12 is a diagrammatic sectional view of a sixth variant of the pressing device according to the invention.

In a further variant illustrated in FIG. 12, the body 1 is constituted by an upper part 100*a* connected to the outer slide (not shown) of the press and a distinct lower part 100*b* whose lower surface constitutes the upper peripheral blank holder.

Interposed between the two parts 100*a* and 100*b* of the body 1 is at least one means 101 for modifying the penetration of the upper blank holder into the elastic cushion 6. This means 101 may comprise for example a spring or a jack or any other suitable system which limits the extent to which the upper blank holder penetrates the cushion when the pressure in the cushion becomes higher than a given value.

The means for absorbing the excess volume of the elastic cushion 6 may also be formed by at least one lateral wall of the box 2 which cooperates with an element constituted for example by at least one spring or jack for controlling the displacement of the lateral wall in accordance with the pressure exerted in the elastic cushion.

The device according to the invention is applicable not only in the case where the sheet blank rests on a lower blank holder constituted by a frame, but also in the case where the sheet blank bears directly against the elastic cushion in accordance with the teaching of FR-A-2,564,339, and in the case where the sheet blank bears against the upper part of the box retaining the elastic cushion in accordance with the teaching of FR-A-2,590,814.

I claim:

1. A device for pressing a blank of sheet material, comprising a cushion comprising an elastic material, a retaining box surrounding the cushion, said retaining box including a rigid bottom wall for supporting the cushion, means for preforming a sheet blank comprising a central slide, a punch cooperative with the central slide, means for absorbing an excess volume of the elastic cushion relative to the volume determined by the surface area of the finished part to be obtained, wherein said means for absorbing the excess volume of the elastic cushion comprise means adjacent to and movable relative to the elastic cushion for acting on the elastic cushion, and control means cooperative with said means for acting on the elastic cushion for controlling the displacement of said means for acting on the elastic cushion and wherein said means for acting on the elastic cushion comprises said rigid bottom wall of the retaining box, and said control means are cooperative with said rigid bottom wall for controlling the displacement of said rigid bottom wall.

2. A device according to claim 1, wherein said means for acting on the elastic cushion comprise at least one movable lateral wall of the retaining box, and said control means are cooperative with said at least one movable lateral wall for controlling the displacement of said at least one lateral wall relative to the elastic cushion.

3. A device according to claim 1, wherein said means for acting on the elastic cushion comprise said upper blank holder, and said control means are cooperative with the upper blank holder for controlling penetration of the upper blank holder into the elastic cushion.

4. A device according to claim 1, wherein said means for acting on the elastic cushion comprise a piston which is movable between a first position and a second position relative to the elastic cushion, said control means comprising a multiplate brake having first friction plates connected to the piston and second friction plates interposed between said first friction plates, a fixed sole plate connected to said second friction plates, and return means for returning the piston to said first position.

5. A device according to claim 4, comprising means for actuating the multiplate brake and including two levers, an articulation assembling the two levers as a toggle associated with the friction plates for gripping the friction plates together, a rod articulated to said articulation assembling the two levers, and at least one jack connected to the rod.

6. A device according to claim 1, wherein said means for acting on the elastic cushion comprise a piston movable between a first position and a second position relative to the elastic cushion, and said control means comprise a reversible screw connected to rotate with the piston, a brake comprising a belt cooperative with the piston, and return means for returning the piston to said first position.

7. A device according to claim 6, wherein said brake comprises a rotatable nut screw-threadedly engaged with the screw and defining a guide groove on the periphery of the nut for receiving said belt, and a jack associated with the belt for controlling the tension of the belt.

8. A device according to claim 1, wherein said means for acting on the elastic cushion comprise a movable piston, a reversible screw connected to rotate with the piston, and a step-by-step drive mechanism associated with the reversible screw.

9. A device according to claim 8, wherein the step-by-step drive mechanism comprises a rotatable nut screw-threadedly engaged with the screw, a toothed groove provided on the periphery of the nut, and a worm cooperative with the toothed groove.

10. A device according to claim 1, wherein said means for acting on the elastic cushion comprise a movable piston and said control means comprise a hydraulic jack cooperative with said movable piston.

11. A device according to claim 1, wherein said means for acting on the elastic cushion comprise a movable piston, and said control means comprise a hydraulic valve and a pheumatic valve connected to the hydraulic valve for controlling the hydraulic valve.

12. A device according to claim 11, comprising a small piston carrying said hydraulic valve and subjected to compressed air pressure distributed through the pneumatic valve, and a cup having an upper wall defining a central orifice constituting a valve seat, said small piston being slidably mounted in said cup.

13. A device according to claim 12, wherein said cup defines with said movable piston an upper chamber and with said small piston an inner chamber, and a fluid fills said chambers, said chambers intercommunicating through said central orifice.

14. A device according to claim 13, comprising means defining a cylindrical cavity constituting a fluid reservoir which communicates with said upper chamber and with said inner chamber.

15. A device for pressing a blank of sheet material into a finished part, comprising:

a cushion comprising an elastic material;

an enclosure for retaining said cushion, said enclosure having walls;

a means for forming the sheet blank, said means comprising a punch member which selectively contacts the sheet blank and urges at least a section of the sheet blank to contact said cushion; and, a means for absorbing an excess volume of said cushion relative to the volume determined by the surface area of the finished part to be obtained from the sheet blank, said means comprising:

a rigid body operatively contacting said cushion, wherein said rigid body comprises a bottom wall section of said enclosure, and a control means for selectively displacing said rigid body in relation to said cushion.

16. A device for pressing a blank of sheet material into a finished part, comprising:

a cushion comprising an elastic material;

an enclosure for retaining said cushion, said enclosure having walls;

a means for forming the sheet blank, said means comprising a punch member which selectively contacts the sheet blank and urges at least a section of the sheet blank to contact said cushion; and, a means for absorbing an excess volume of said cushion relative to the volume determined by the surface area of the finished part to be obtained from the sheet blank, said means comprising:

a rigid body operatively contacting said cushion, wherein said rigid body operatively contacting said cushion comprises a lateral wall of said enclosure, and a control means for selectively displacing said rigid body in relation to said cushion.

17. The device of claim 15 wherein said enclosure comprises an open topped box and further comprising an upper blank holder and a lower blank holder which together hold a portion of the sheet blank between them, said lower blank holder resting on said cushion and wherein said upper blank holder comprises said rigid body operatively contacting said cushion.

18. The device of claim 15 wherein said rigid body comprises a piston movable between a first position and a second position relative to said cushion.

* * * * *